United States Patent [19]

Mahar et al.

[11] Patent Number: 5,029,657

[45] Date of Patent: Jul. 9, 1991

[54] ROCK DRILL BIT

[76] Inventors: Arthur Mahar, Box 230; Gerald Lund, Jr., P.O. Box 156, both of Pembroke, Me. 04666

[21] Appl. No.: 436,544

[22] Filed: Nov. 14, 1989

[51] Int. Cl.[5] ..... E21B 10/38; E21B 10/60

[52] U.S. Cl. ..... 175/393; 175/415; 175/417

[58] Field of Search ..... 175/417, 418, 415, 393, 175/340, 339, 231, 317, 324

[56] References Cited

U.S. PATENT DOCUMENTS

| | | | |
|---|---|---|---|
| 1,529,112 | 3/1925 | Burns . | |
| 1,993,182 | 3/1935 | Santiago . | |
| 2,046,598 | 7/1936 | Abegg . | |
| 2,108,955 | 2/1938 | Zublin | 175/340 |
| 2,293,259 | 8/1942 | Johnson . | |
| 2,340,738 | 2/1944 | Dilley | 175/393 X |
| 2,357,835 | 9/1944 | Leissler . | |
| 2,365,941 | 12/1944 | Crake | 175/393 |
| 2,710,741 | 6/1955 | Hall, Sr. | 175/340 X |
| 2,900,171 | 8/1959 | Miller et al. . | |
| 2,950,089 | 8/1960 | Irons | 175/393 |
| 3,111,179 | 11/1963 | Albers et al. | 175/393 |
| 3,645,331 | 2/1972 | Maurer et al. | 175/393 X |
| 4,022,285 | 5/1977 | Frank | 175/65 |
| 4,083,417 | 4/1978 | Arnold | 175/393 |
| 4,222,447 | 9/1980 | Cholet | 175/340 |
| 4,239,087 | 12/1980 | Castel et al. | 175/340 |
| 4,240,513 | 12/1980 | Castel et al. | 175/340 |
| 4,436,166 | 3/1984 | Hayatdavoudi et al. | 175/65 |
| 4,440,247 | 4/1984 | Sartor | 175/393 |
| 4,479,558 | 10/1984 | Gill et al. | 175/324 X |
| 4,489,793 | 12/1984 | Boren | 175/324 X |
| 4,540,055 | 9/1985 | Drummond et al. | 175/324 X |
| 4,619,335 | 10/1986 | McCullough | 175/339 |
| 4,727,943 | 3/1988 | Wood | 175/340 X |

FOREIGN PATENT DOCUMENTS

| | | | |
|---|---|---|---|
| 994672 | 2/1983 | U.S.S.R. | 175/339 |
| 1002503 | 3/1983 | U.S.S.R. | 175/393 |
| 1004601 | 3/1983 | U.S.S.R. | 175/339 |
| 1071418 | 6/1967 | United Kingdom | 175/418 |

*Primary Examiner*—Hoang C. Dang

*Attorney, Agent, or Firm*—Fish & Richardson

[57] ABSTRACT

A rock drill bit for continuous drilling through overburden and rock has a body with end and side surfaces. The drill bit is constructed for rotation in a predetermined direction. The body defines a conduit for compressed air which terminates at a port in the side surface of the body. The port is disposed to open in a direction facing generally away from the predetermined direction of rotation of the drill bit.

4 Claims, 4 Drawing Sheets

ROCK DRILL BIT

This invention relates to rock drill bits, e.g. of the type used for drilling blasting holes and test drilling for ledge profile.

Typically, drilling of this nature is done with a drill bit mounted on a jack-hammer by means of one or more hollow drill steels or rods coupled in a string between hammer and bit. A downfeed device applies downward pressure as the jack-hammer rotates the drill bit at a relatively slow speed and pounds the drill into the earth. Compressed air delivered into the hole from orifices in the bottom and side surfaces of the drill is adequate to blow from the hole small rock chips and rock dust removed as the drill takes tiny bites of rock. However, much drilling of this nature occurs through overburden, e.g. loam, clay, sandstone, etc., through which the drill is rapidly forced unless great care is taken by the drill operator. When this occurs, as it often does, the drill bit orifices and even extended lengths of the drill steels string can become blocked requiring considerable downtime for replacement or unblocking of the bit and drill steels before drilling can resume. It is often said that anyone can drill rock, but even experts have problems drilling overburden.

Objectives of this invention include providing a drill bit capable of improved drilling performance through overburden and providing a drill bit capable of nonstop drilling through overburden and underlying rock.

SUMMARY OF THE INVENTION

According to the invention, a rock drill bit adapted for continuous drilling through overburden and rock comprises a body having an end surface and a side surface, means for attachment of the drill bit to drive means for rotation of the drill bit in a predetermined direction, the body defining a conduit for compressed air terminating at a port defined in the side surface of the body, the port disposed to open in a direction facing generally away from the predetermined direction of rotation of the drill bit.

Preferred embodiments of the invention may include one or more of the following features. The side surface further defines a side surface depression and the port terminates in the depression. The rock drill bit further comprises means for attachment of the drill bit to drive means for axial drilling motion of the drill bit, and the depression is disposed on the side surface to extend relative to the port at an incline away from the direction of axial drilling motion. The rock drill bit further comprises a multiplicity of ports. The rock drill bit has the form of a prior art drill bit having side and end orifices modified to obstruct movement of air therethrough.

These and other features and advantages will be seen from the following description of a presently preferred embodiment, and from the claims.

PREFERRED EMBODIMENT

We first briefly describe the drawings.

Figure 1:
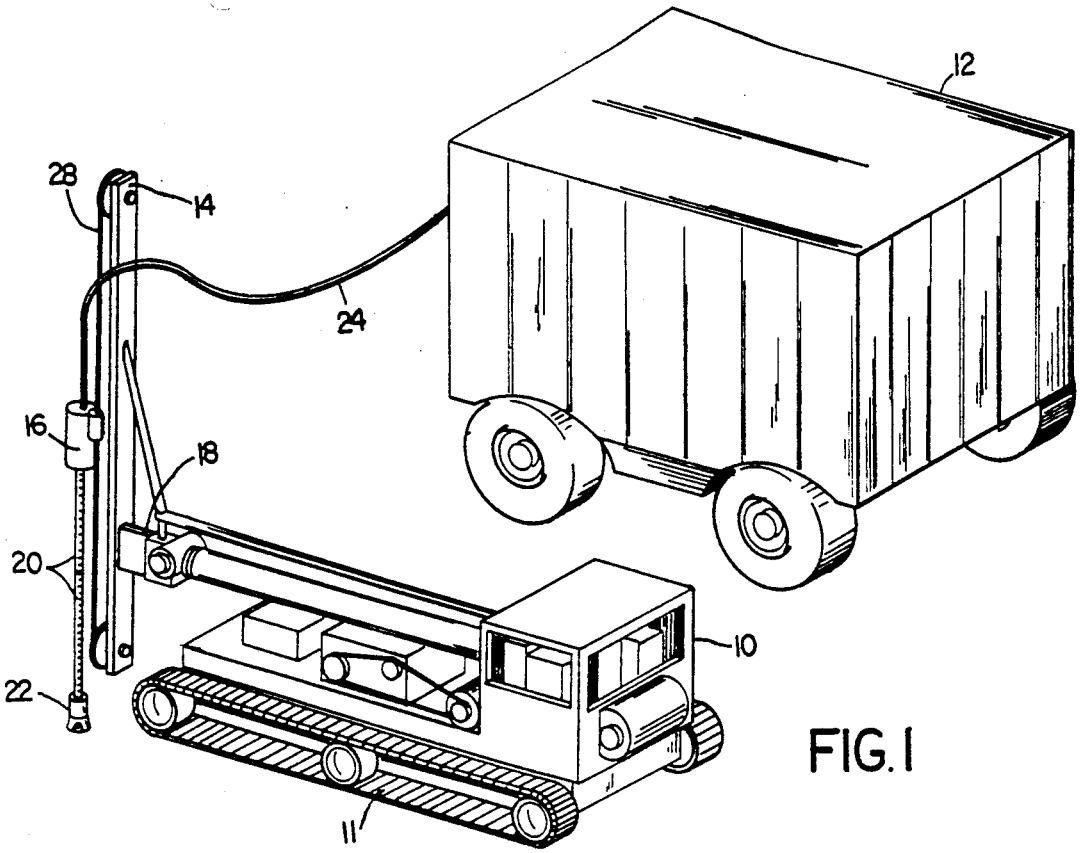
FIG. 1 is a somewhat schematic perspective view of a typical drilling operation, e.g. of blasting holes, through overburden and underlying rock.
Figure 2:
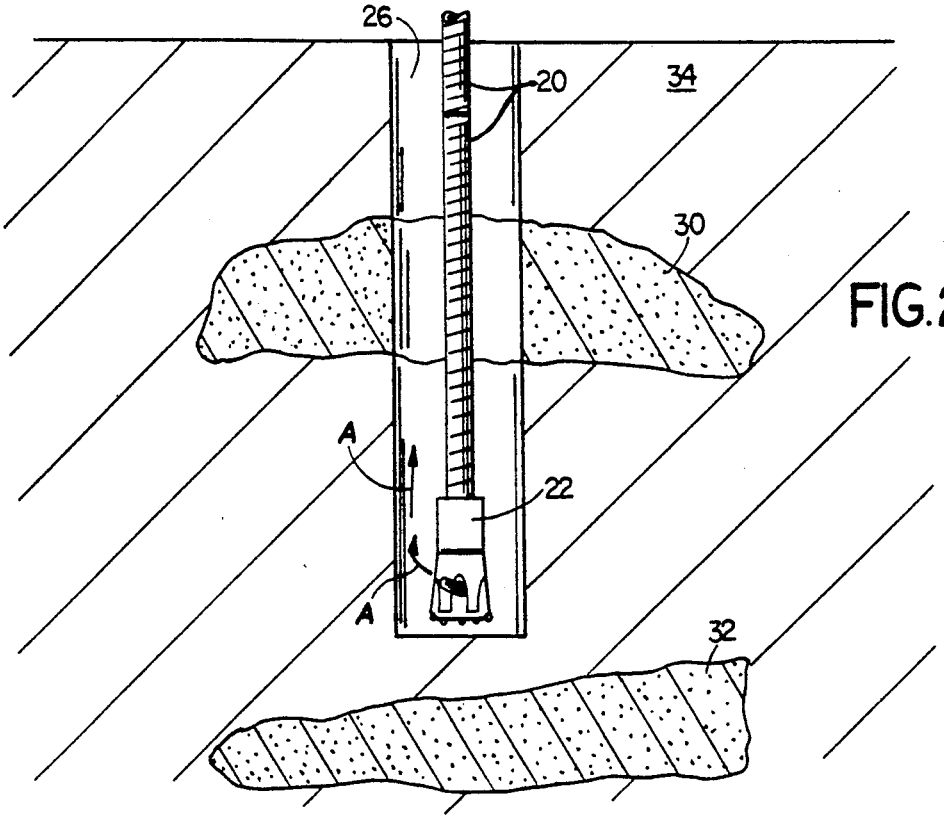
FIG. 2 is a somewhat diagrammatic view of a rock drill bit of the invention drilling a blasting hole.

Referring to FIG. 1, a typical apparatus for drilling, blasting holes and test drilling for ledge profiles consists of a mobile vehicle 10, e.g. an "air-trac" vehicle supplied by Gardner-Denver Company of Denver, Colo., with crawler tracks 11, and an air compressor 12.

The vehicle 10 carries a mast 14 upon which there is a chain-fed, slidingly mounted jack-hammer 16. The mast is attached to vehicle 10 by means of one or more hydraulic cylinders 18 which allow the jack-hammer to be positioned precisely at a location desired for drilling and at a desired angle.

Extending from the hammer are one or more hollow drill steels or rods 20 coupled together in a string and terminating at rock drill bit 22. An air hose 24 delivers compressed air from compressor 12 into jack-hammer 16 to pass through the hammer and hollow drill steels to exit into the hole 26 by way of orifices provided in the drill bit, as will be described below.

During the drilling operation, the jack-hammer 16 rotates the drill bit 22 slowly as it pounds the bit into the ground. At the same time, roller chain 28 powered by an air motor (not shown) on the mast applies constant downward pressure against the bit. Pressurized air delivered, e.g., at 90 psi, flows into the hole from the bit to blow small rock chips and dust away from the drilling region (arrows A).

The operation usually proceeds quickly and smoothly as the drill bit takes small bites while drilling through rock 30 or ledge 32. However, when drilling through overburden 34, the operation must proceed with great caution to prevent the bit from penetrating too quickly, which can cause the orifices in the drill bit to be clogged with dirt, sand or the like.

If the drill bit air passages become blocked, the drilling operation must be interrupted. The drill steels string and bit assembly is withdrawn from the hole and the blockage cleared (in severe cases, the blockage may even extend for several feet or more into the drill steels string passageway). The result is expensive and inefficient operation.

Figure 3:
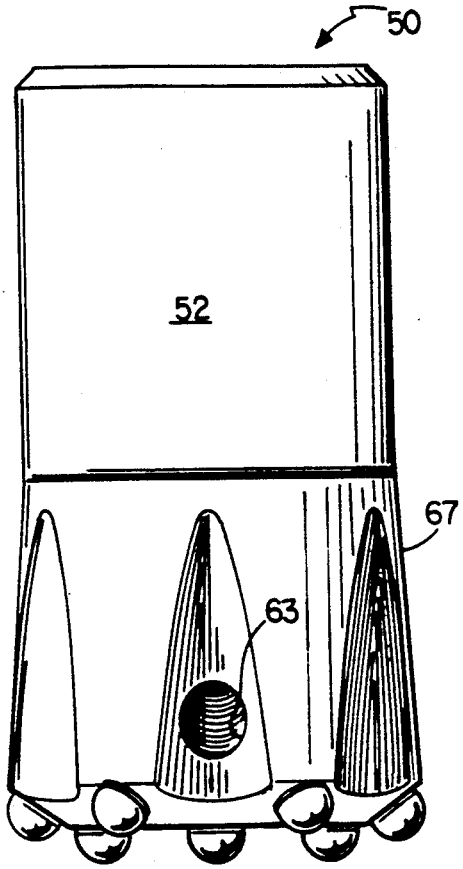
PRIOR ART FIG. 3
FIGS. 3, 3A and 3B are side, end and side section views of a prior art rock drill bit.
Figure 3A:
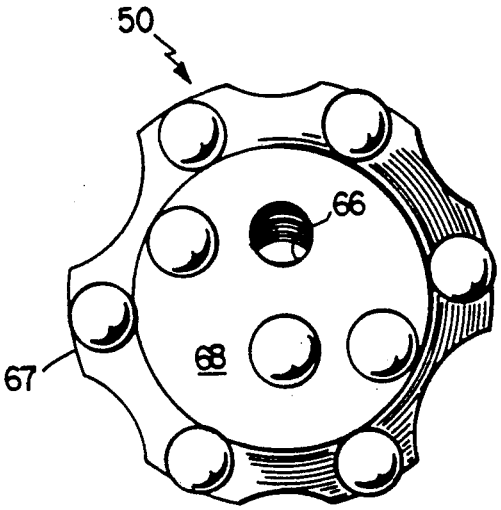
PRIOR ART FIG. 3A
Figure 3B:
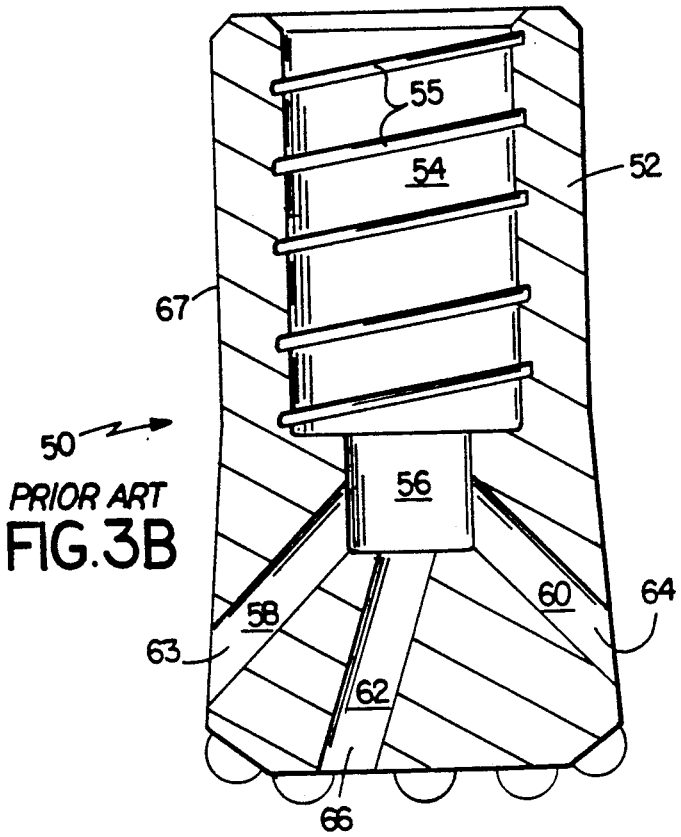
PRIOR ART FIG. 3B

Referring now to FIGS. 3, 3A and 3B, a prior art drill bit 50, e.g. a button bit as sold by Ingersoll-Rand of Woodcliff Lake, N.J., has a body 52, e.g., of tool steel, having a central cavity 54 defining threads 55 for attachment to the drill steels string. A smaller cavity 56 at the lower end of cavity 54 connects cavity 54 to passageways 58, 60, 62, which terminate at orifices 63, 64 in the side surface 67 and at orifice 66 in end surface 68. As described above, compressed air delivered into cavity 54 flows into smaller cavity 56 and, from there, exits into the hole 26 from orifices 63, 64, 66 via passageways 58, 60, 62. During drilling through overburden, great care must be taken to prevent dirt, sand and the like from being forced into the drill bit via orifices 63, 64, 66 to block flow of air from the drill bit, as very often occurs.

Figure 4:
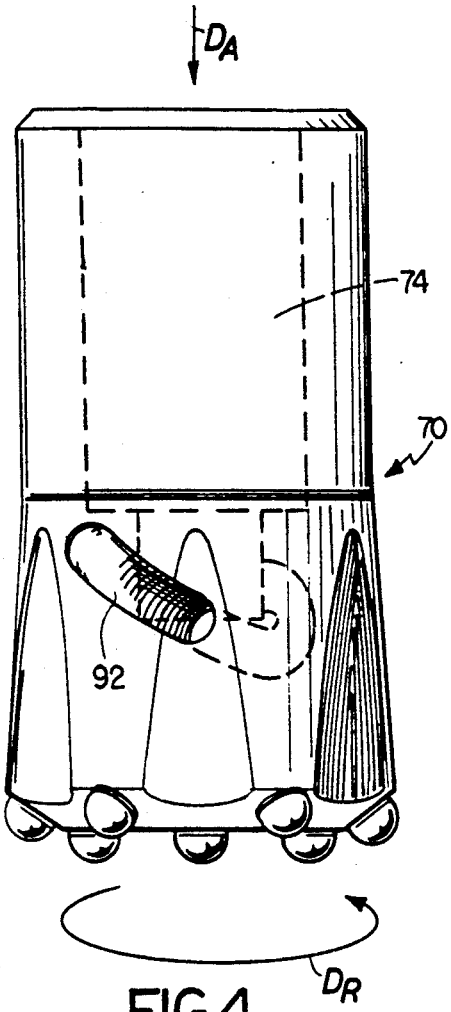
FIGS. 4, 4A and 4B are similar views of one embodiment of rock drill bit of the invention.
Figure 4A:
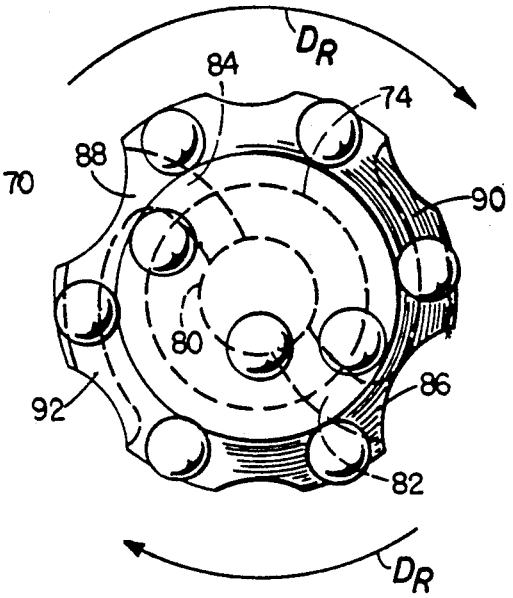
Figure 4B:
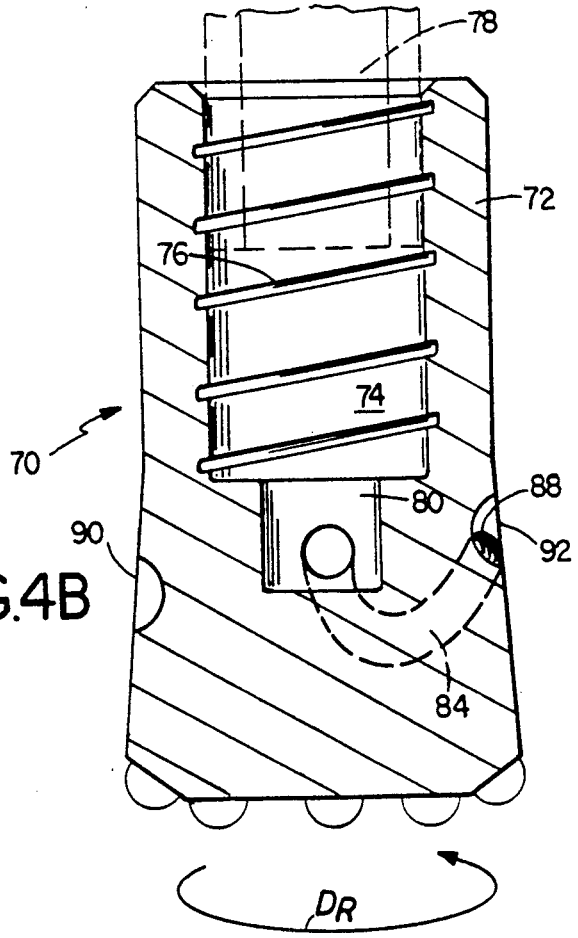

According to the invention, there is provided a drill bit 70 (FIGS. 4, 4A and 4B) of improved configuration that resists movement of dirt and the like into the drill bit and reduces the potential for blockage of air flow. Referring to the drawings, drill bit 70 has a body 72 having a central cavity 74 defining threads 76 for attachment to the drill steels string (78). A smaller cavity 80 at the lower end of cavity 74 connects that cavity to two passageways 82, 84 which terminate at ports 86, 88 in elongated side surface depressions 90, 92. The ports 86, 88 open in a direction away from the rotational direction of the drill bit (arrow DR) and the side surface depressions 90, 92 slope upwardly at an angle away from the axial direction of drilling (arrow DA) and also away from the direction of rotation. As a result, air delivered into the drill bit freely exits from the central cavity via ports 86, 88 into the side surface depressions with little or no instances of blockage.

Figure 5:
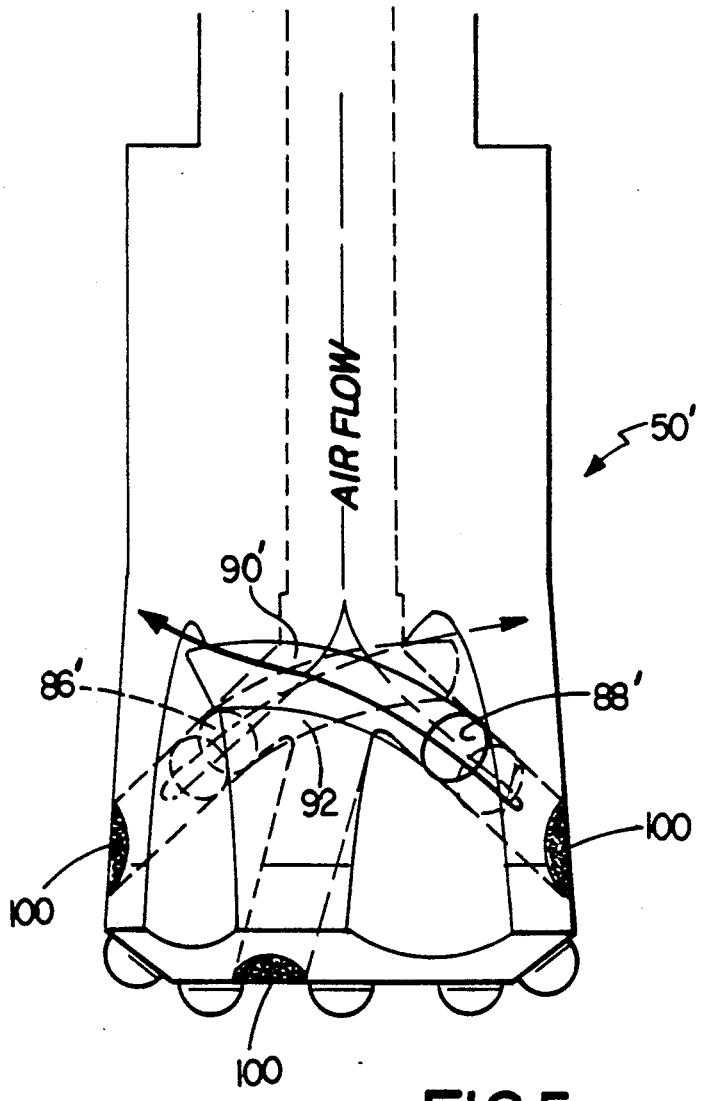
FIG. 5 is a side section view of another embodiment of a rock drill bit of the invention, i.e. a rock drill bit of prior art configuration modified according to the invention.

In another embodiment of the drill bit of the invention shown in FIG. 5, a prior art drill bit 50' is modified by depositing plug welds 100 in each of the existing side and end orifices and new ports 86', 88' in new side surface depressions 90', 92' are provided.

In test drillings performed with drill bits of the invention, it was found that continuous drilling through overburden and rock was possible with a resulting improvement in drilling time required of about 15:1 over prior art practices.

Other embodiments are within the following claims:

What is claimed is:

1. A drill bit adapted for continuous impact drilling in an axial direction through overburden and rock comprising a body having an end surface and a side surface, said end surface being completely closed, said body being void of any fluid passages which have openings directed downwardly, said body defining means for attachment of said drill bit to drive means for rotation of said drill bit in a predetermined direction, said body further defining a conduit for compressed air, said conduit terminating at a port defined in said side surface of said body and disposed to open in a direction facing generally opposite the predetermined direction of rotation of said drill bit and generally perpendicular to the axial direction of drilling so as to avoid clogging during rotation of said drill bit for continuous impact drilling through overburden and rock.

2. The drill bit of claim 1 wherein said side surface further defines a side surface depression and said port terminates in said depression.

3. The drill bit of claim 2 further comprising means for attachment of said drill bit to drive means for axial drilling motion of said drill bit, and said depression is arrayed on said surface to extend relative to said port at an incline away from the direction of axial drilling motion.

4. The drill bit of claim 1 further comprising a multiplicity of said ports.

* * * * *